US005996680A

United States Patent [19]

Fukase et al.

[11] Patent Number: 5,996,680

[45] Date of Patent: Dec. 7, 1999

[54] TWIN ROLL CASTING

[75] Inventors: Hisahiko Fukase, Wollongong, Australia; Heiji Kato, Yokosuka; Atsushi Hirata, Hiratsuka, both of Japan

[73] Assignees: Ishikawajima-Harima Heavy Industries Co., Limited, Tokyo, Japan; BHP Steel (JLA) Pty Ltd., Melbourne, Australia

[21] Appl. No.: 09/116,895

[22] Filed: Jul. 17, 1998

[30] Foreign Application Priority Data

Jul. 30, 1997 [AU] Australia ..... P08328

[51] Int. Cl.[6] ..... B22D 11/124

[52] U.S. Cl. ..... 164/428; 164/442; 164/448

[58] Field of Search ..... 164/428, 480, 164/448, 442, 348; 492/46

[56] References Cited

U.S. PATENT DOCUMENTS 4,090,553 5/1978 Beghin ..... 164/448

*Primary Examiner*—Kuang Y. Lin

*Attorney, Agent, or Firm*—Kerkam, Stowell, Kondracki & Clarke, P.C.; John C. Kerins

[57] ABSTRACT

Twin-roll caster for continuously casting metal strip comprises a pair of parallel casting rolls (1) each provided with longitudinal cooling water passages (26) adjacent other casting surfaces 25 of the rolls. Passages (26) are interconnected in groups of three to form three pass zig-zag water flow channels for flow of water back and forth between the roll ends. The roll ends are notched to form outwardly facing shoulders (44) for engagement with casting pool confining plates (10). Cooling water flows to and from the passages (26) through radial passages (35, 36) in roll end walls (27, 28) in the vicinity of the shoulders (44).

13 Claims, 5 Drawing Sheets

TWIN ROLL CASTING

BACKGROUND OF THE INVENTION

1. Field of the Invention

This invention relates to twin roll casting of metal strip. It has particular, but not exclusive application to the casting of ferrous metal strip.

2. Description of Related Art

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

The casting surfaces of the casting rolls are generally provided by outer circumferential walls provided with longitudinal cooling water passages to and from which water is delivered through generally radial passages in end walls of the rolls. When casting ferrous metals the rolls must support molten metal at very high temperatures of the order of 1640° C. and their peripheral surfaces must be maintained at a closely uniform temperature throughout in order to achieve uniform solidification of the metal and to avoid localised overheating of the roll surface.

It has been found that very small changes in cooling efficiency across each roll from one end to the other can cause the production of strip of asymmetrically cross section ie. strip having an asymmetrical thickness variation across the width of the strip.

The most desirable strip cross-section may vary according to the particular use intended for the strip. For example, if the strip is to be subsequently cold rolled it should desirably be produced with a small positive crown in the centre, ie. it should be slightly thicker in the centre than at its edges. However, if the strip is to be subsequently used in its as-cast state it may be produced with uniform thickness across its width. The casting rolls must be machined to an initial profile such that when they expand on heating to their operating temperature they adopt a profile which produces a strip of the required shape. In all cases it is desirable that the shape of the strip be symmetrical. However, this has proved very difficult and we have found in particular that the shape of the strip will commonly depart from the desired design shape toward the outer edges of the strip and in particular one edge margin is often significantly thicker than the other.

SUMMARY OF THE INVENTION

A significant cause of the variations in cooling efficiency from one side of the rolls to the other is due to a change in the temperature of the cooling water as it flows across the roll so that there will be a significant temperature difference of the cooling water from one side of the roll to the other. This problem is addressed by the invention disclosed in our Australian Patent Application 35184/97 by which the direction of flow of cooling water in the two rolls is mutually reversed so as to balance the temperature differential effects on one roll with those of the other. By the present invention it is possible to reduce the temperature differential effects in each roll by providing each roll with a multi-pass cooling water system so that cooling water is passed back and forth across each roll to reduce the average temperature differential from one side of the roll to the other. This multi-pass arrangement may be used as an alternative to a mutually reversed flow arrangement as disclosed in Australian Patent Application Number 35184/97 or in combination with such flow reversal in a system which embodies both inventions.

It has been found that the variations in cooling efficiency occur particularly at the outer end corners of the rolls where it is difficult to maintain a sufficiently high heat interaction rate to prevent localised overheating. This problem can be reduced by extending the cooling passages outwardly into the corner regions of the rolls as disclosed in Australia Patent Application 33021/95 but can be even more effectively overcome by the use of a multi-pass water flow system in accordance with the present invention in conjunction with circumferential notches at the outer corners of the rolls to receive the side dam plates so as to provide for substantially uniform cooling throughout the length of the casting pool.

According to the invention there is provided apparatus for continuously casting metal strip comprising an assembly of a pair of casting rolls forming a nip between them and each provided with water flow passages extending adjacent the outer peripheral surfaces of the rolls longitudinally of the rolls, a metal delivery nozzle for delivery of molten metal into the nip between the casting rolls to form a casting pool of molten metal supported on the cast roll surfaces above the nip, a pair of pool confining walls engaging opposite end parts of the rolls to confine the pool at the ends of the nip, roll drive means to drive the casting rolls in counter-rotational directions to produce a solidified strip of metal delivered downwardly from the nip, and cooling water supply means for supply of cooling water to said longitudinal passages in the rolls, wherein each casting roll comprises central shaft means mounting the roll for rotation about a central axis, a circumferential wall disposed about the central axis and provided with said longitudinal water flow passages, end walls extending between the shaft means and the ends of the circumferential wall, and passages formed in at least one of the end walls for flow of water to and from said longitudinal water flow passages, wherein the longitudinal water flow passages are interconnected in groups such that each group of circumferentially spaced passages forms a single continuous water flow channel for flow of water back and forth between the two ends of the roll in passing from one end of the channel to the other and wherein outer end parts of the circumferential walls of the rolls are notched to define outwardly facing shoulders for engagement with said pool confining plates and said radial passages and interconnections between the longitudinal flow passages are disposed generally at the notched outer end parts of the circumferential walls of the rolls.

Preferably the radial passages and interconnections between the longitudinal flow passages are disposed generally in the vicinity of said shoulders.

The longitudinal passages may be interconnected in groups of three defining three-pass water flow channels.

In that case each roll may have two sets of said radial passages disposed one at each end of the roll with one set communicating with first ends of the water flow channels and the other set communicating with the opposite ends of those channels.

The circumferential wall may comprise an inner tubular roll body and a cylindrical sleeve providing the outer casting surface.

The inner tubular body may be constructed of stainless steel to provide rigidity to the roll during casting.

The cylindrical sleeve may be constructed of copper or copper alloy to provide good heat exchange between the casting pool and the water flowing in the said flow passages.

The rolls may further comprise water supply and return ducts formed internally within the shaft means of the rolls and communicating with said radial passages.

The water supply means may comprise a common source of cooling water for both rolls connected to the water supply ducts to supply cooling water to both rolls at essentially the same temperature.

The common source of cooling water may comprise a cooling water pump connected to the water supply ducts of both rolls.

The water supply means may further comprise a water cooling tower to receive water returned through the said return ducts for recirculation via said pump.

The water supply means may be connected to the rolls such that water is supplied to the radial passages of one roll at one end of the roll assembly and to the radial passages of the other roll at the other end of the roll assembly.

Alternatively the water supply means may be connected to the rolls to supply water at essentially the same temperature to the radial passages of both rolls at the same end of the roll assembly.

In order that the invention may be more fully explained one particular embodiment will be described in some detail with reference to the accompanying drawings in which:

DETAILED DESCRIPTION OF THE PREFERRED EMBODIMENTS

Figure 1:
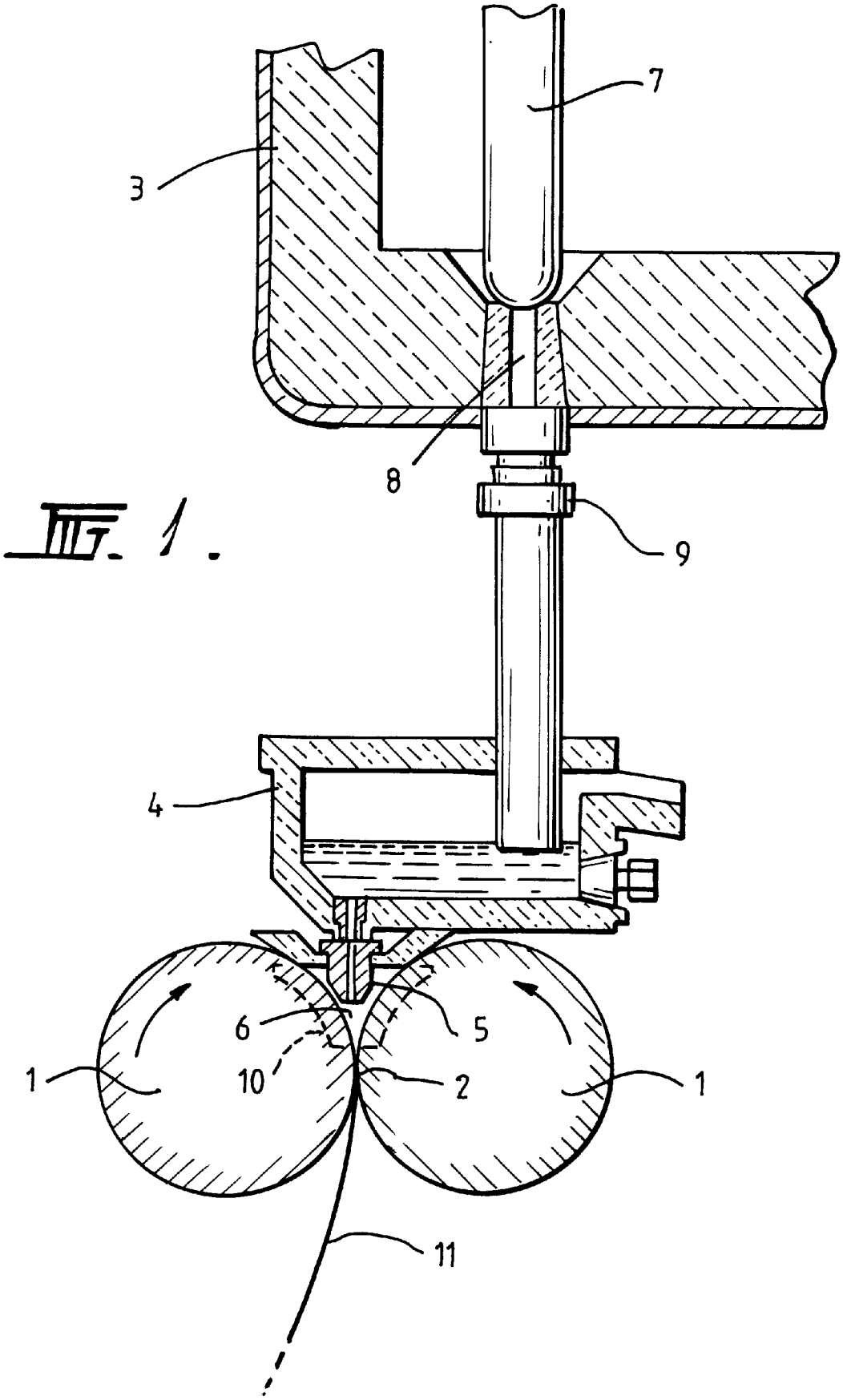
FIG. 1 is a vertical cross-section through a strip caster constructed in accordance with the invention.
Figure 2A:
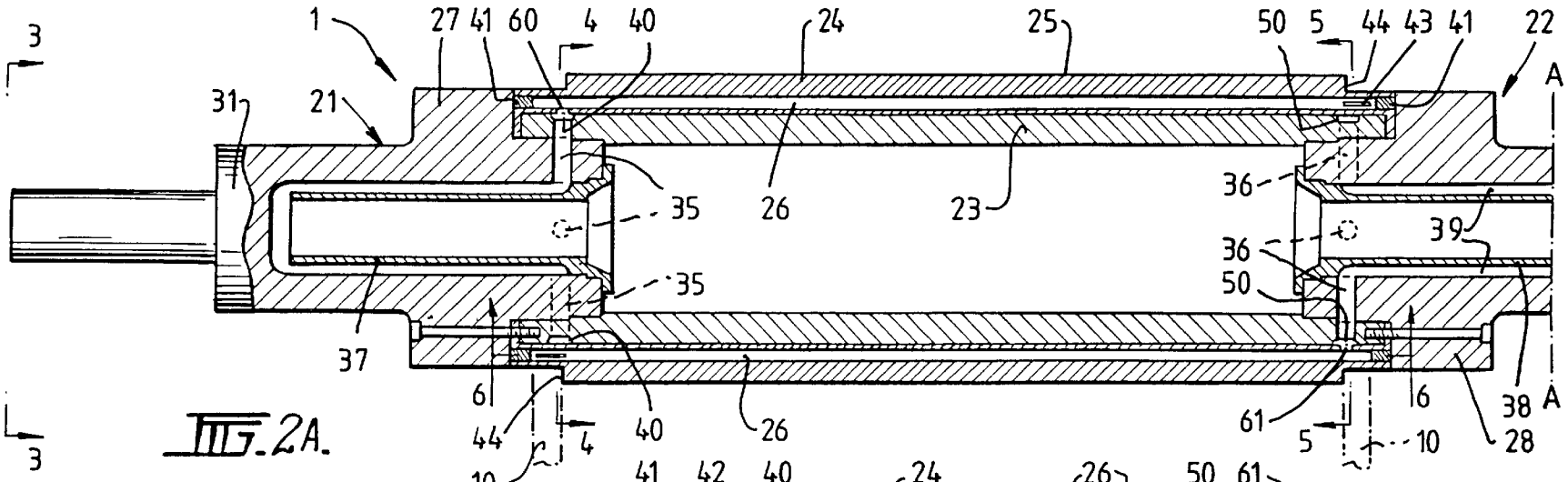
FIGS. 2A and 2B join on the line A—A to form a cross-section through one of the casting rolls of the caster illustrated in FIG. 1.

The illustrated strip caster comprises a pair of twin casting rolls 1 forming a nip 2 between them. Molten metal is supplied during a casting operation from a ladle 3 via a tundish 4 and a delivery nozzle 5 into the nip between rolls 1 so as to produce a casting pool 6 of molten metal above the nip. The ends of the casting pool are confined by a pair of refractory confining plates 10 which engage notched ends of the rolls as described below. Ladle 3 is fitted with a stopper rod 7 actuable to allow the molten metal to flow from the ladle through an outlet nozzle 8 and a refractory shroud 9 into tundish 4.

Casting rolls 1 are provided in a manner to be described in detail below with internal water cooling passages supplied with cooling water through the roller ends and they are contra-rotated by drive means (not shown) to produce a continuous strip product 11 which is delivered downwardly from the nip between the casting rolls.

As thus far described the illustrated apparatus is as more fully described in granted U.S. Pat. 5,184,668 and 5,277,243 and Australian Patents 631728 and 637548. Reference may be made to these patents, the disclosures of which are, incorporated herein by reference for full constructional and operational details of the apparatus.

The two rolls are of identical construction and each is provided around its periphery with longitudinal water flow passages to and from which water is supplied through radial passages in end parts of the roll.

Each casting roll 1 is formed by two roll end pieces 21, 22 interconnected by a central stainless steel tubular roll body 23 around which is shrink fitted a thick cylindrical copper alloy sleeve 24 providing the outer casting surface 25 of the roll and formed with the longitudinal water flow passages 26. The formation of a cylindrical roll wall in this way enables a roll construction which has good mechanical strength as well as good heat exchange between the casting pool and the water flowing in passages 26. It has been found that the use of rolls having a one-piece circumferential wall can suffer either from low heat conductivity or when using materials of high heat conductivity can suffer from a lack of mechanical strength under the high thermal cycling that casting provides and leads to early thermal fatigue.

Roll end pieces 21 and 22 are formed with thick flanges 27, 28 which form end walls for the rolls and projecting shaft portions 31, 32 by which the rolls are rotatable mounted and driven. The shaft portion 32 of roll end piece 22 is much longer than that of the other roll end piece 21 and it is provided with two sets of water flow ports 33, 34 for connection with rotary water flow couplings (not shown) by which water is delivered to and from the roll and to pass to and from the longitudinal water flow passages 26 via radial passages 35, 36 extending through the roll end pieces 21, 22 and the ends of the roll body 23 and connecting with annular galleries 40 and 50 which are formed in the outer periphery of body 23 to provide communication with the longitudinal passages around the circumference of the roll. The roll end pieces 21, 22 are fitted central spacer tubes 37, 38 to define separate internal water flow ducts within the roll for the inflowing and outflowing water. In this way the ports 33 communicate through an annular duct 39 disposed outside the tube 38 with the radial flow passages 36 whereas the radial flow passages 35 communicate through a duct formed by the hollow interior of the roll and the interior of tube 38 with the water flow ports 34. As discussed below the water flow ports 33, 34 may be connected to water supply and return line so that water may flow to and from the roll in either direction.

Water flow passages 26 are formed by drilling long holes through the copper sleeve 25 and plugging the ends of the holes by end plugs 41. End connections are made between adjacent passages 26 at the two ends of the rolls to interconnect groups of three successive holes to form a continuous zigzag water flow channel to provide for back and forth flow of cooling water across the roll between the radial passages 35 and 36.

Figure 6:
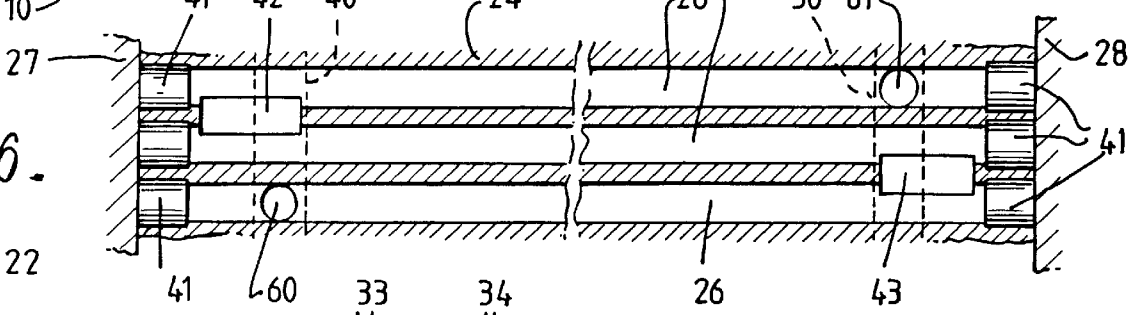
FIG. 6 is a scrap view generally on the line 6—6 in FIG. 2.
Figure 2B:
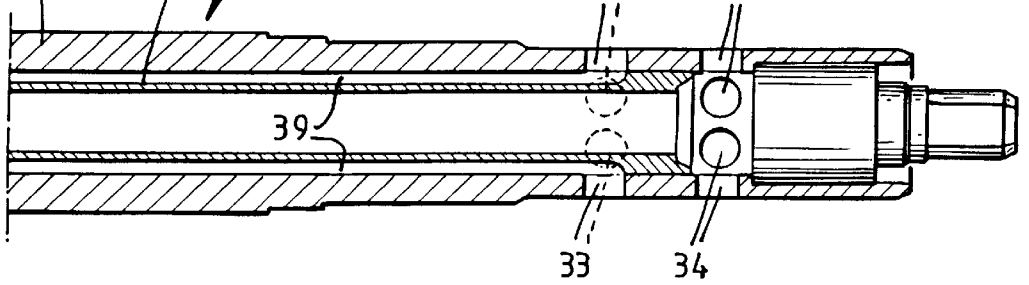
Figure 3:
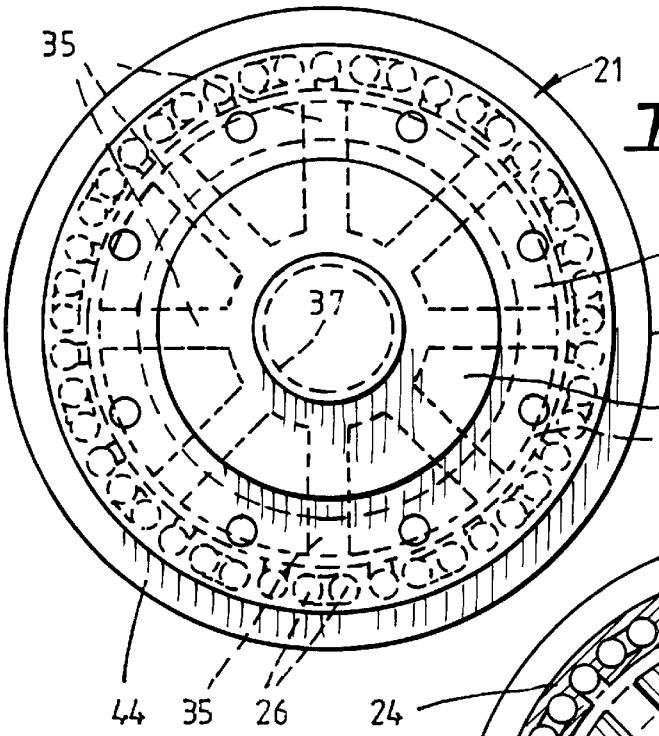
FIG. 3 is a view on the line 3—3 in FIG. 2.
Figure 4:
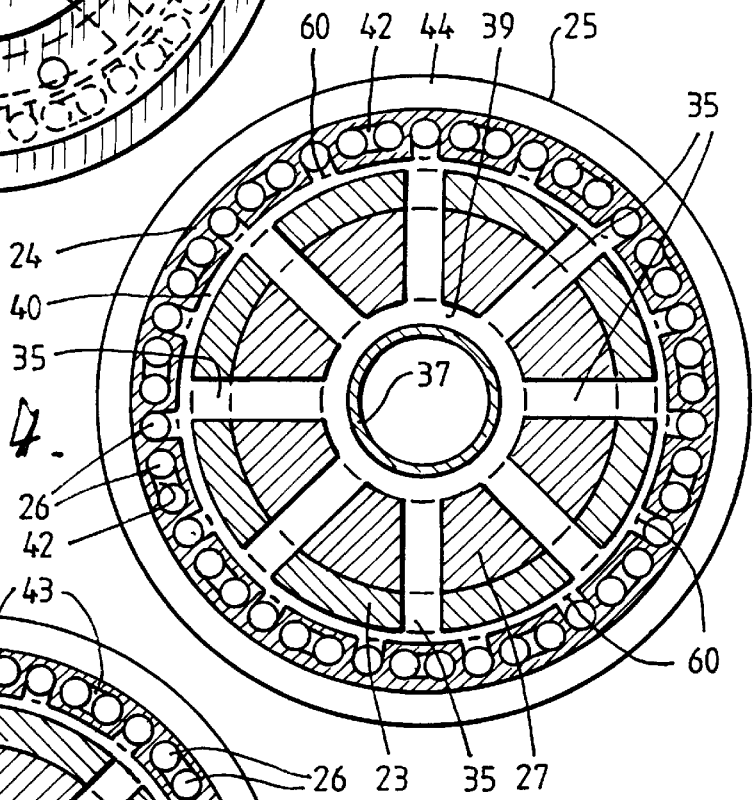
FIG. 4 is a cross-section on the line 4—4 in FIG. 2.
Figure 5:
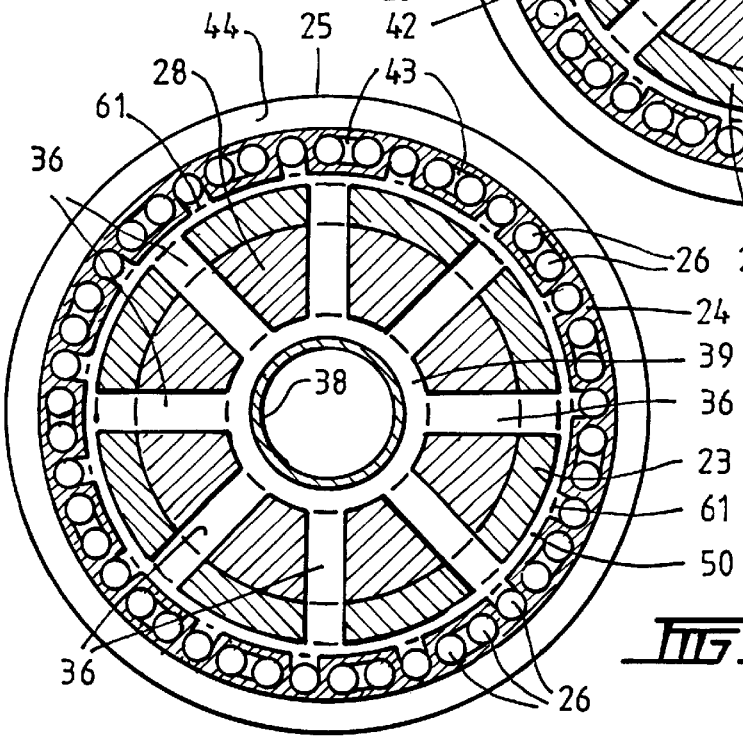
FIG. 5 is a cross-section on the line 5—5 in FIG. 2.

As most clearly seen in FIG. 6 the first and second holes of each group of three holes is joined by interconnecting side gallery 42 at one end of the roll and the second and third holes are joined by interconnecting side gallery 43 at the other end of the roll. The ends of the zigzag channels connect via radial holes 60, 61 in the outer sleeve and the annular galleries 40, 50 with the radial passages 35, 36. In this way there is a multi-pass flow of cooling water between the ends of the rolls. More specifically the water flows from one set of radial passages along the roll in one direction to the other end of the roll, then back to the original end of the roll before returning back to the other end of the roll to leave the roll via the radial passages at that other end of the roll.

Because of the multi-pass arrangement, cooling water which has absorbed heat in passing from one end of the roll to the other is returned to the original end of the roll at a higher temperature before passing to the exit end of the roll. This causes the average temperature of the water at the original end of the roll to be raised and so reduces the temperature differential between the two ends of the roll. Although the drawings illustrate a three pass arrangement it will be appreciated that the holes forming the longitudinal water flow passages may be grouped and interconnected in a manner to provide more than three passes of cooling water across the roll. It would also be possible to provide a two pass arrangement in which water was supplied to and taken from the longitudinal passages 26 at the same end of the roll. This would require longitudinally spaced annular galleries to connect with the ends of the interconnected longitudinal holes at the one end of the roll to separate the incoming and outgoing water flow. However the two pass arrangement has the advantage that the average temperature of the water flow at the two ends of the rolls are substantially equalised and the temperature differential between the roll ends is effectively eliminated.

The galleries 42, 43 interconnecting adjacent longitudinal passages 26 can be formed by inserting side cutting tools in the ends of the holes and moving those tools sideways to form the interconnecting galleries before the ends of the holes are plugged. Because of the need to form these interconnections between successive longitudinal holes in accordance with the invention, the water flow can not be taken through to the extreme ends of the copper sleeve 25. As previously mentioned even cooling of the ends of the casting surfaces is particularly critical and difficult to achieve. For this reason the outer end parts of sleeve 25 are notched to define outwardly facing shoulders 44 for engagement with the pool confining or damming refractory side plates 10 and the interconnecting passages 44 and radial passages 35, 36 are disposed at the notched outer end parts immediately adjacent the shoulders 44. With this arrangement the cooling water flows in essentially straight line unobstructed paths substantially throughout the effective length of the casting surfaces between the pool confining side plates 10. Temperature fluctuations at the ends of the sleeve due to the uneven exposure of these parts of the roll to cooling water and the need for the cooling water to change flow direction are of no consequence since they are not in contact with the casting pool.

Figure 7:
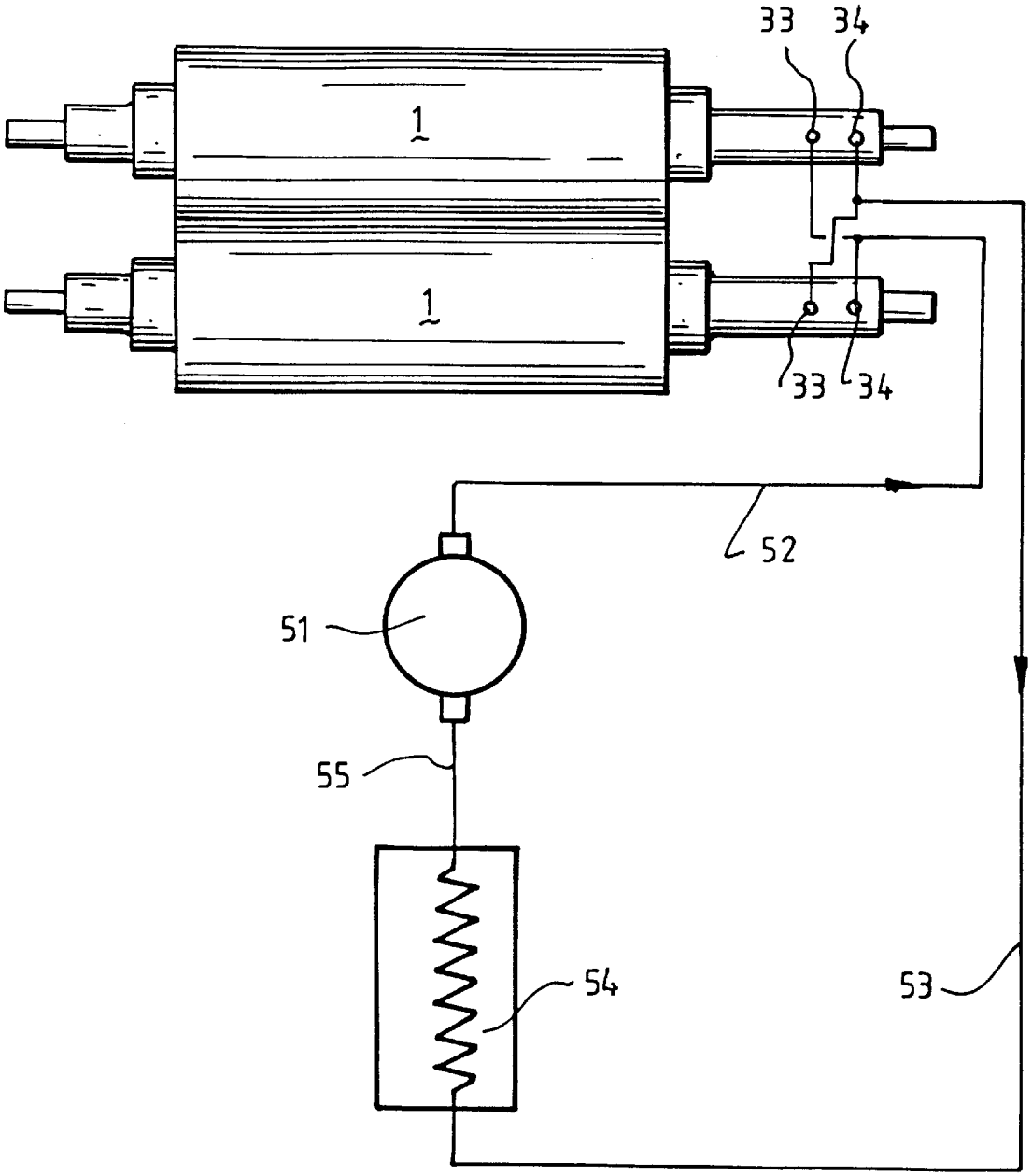
FIG. 7 illustrates one manner in which a water supply may be connected to cooling water passages in the casting rolls in accordance with the present invention.
Figure 8:
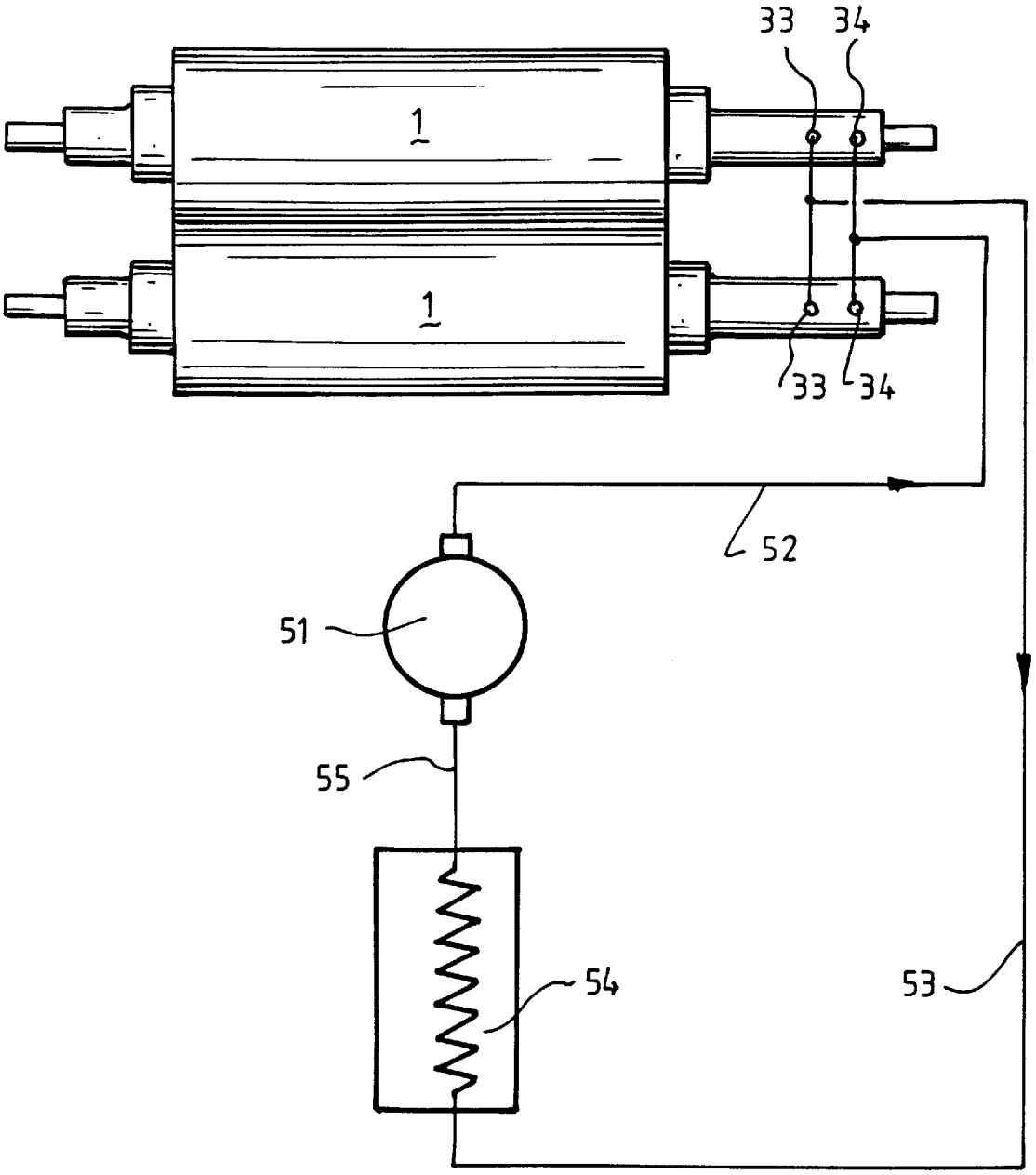
FIG. 8 illustrates an alternative manner of connecting the water supply to the cooling water passages in the casting rolls.

FIG. 7 illustrates one manner in which cooling water may be supplied to the rolls. This figure illustrates a pump 51 which delivers water through supply line 52 to the ports 33 of one roll 1 and the ports 34 of the other roll so that water is delivered to the radial passages at one end of one roll and to the other end of the second roll. Water flows from the other ports through discharge line 53 to a cooling tower 54 and back to the pump through a return line 55. Since both of the rolls receive cooling water from the common supply pump 51, cooling water is delivered to both rolls at essentially the same temperature. Since temperature differences across each of the rolls are minimised by the multi-pass arrangement, very even temperature distribution across both rolls is achieved. Moreover differential expansion effects due to a temperature difference across one roll tends to be off set against movements of the other roll due to the mutual reversal of the flow direction to the two rolls. However this flow reversal is not essential to the present invention and the direction of water flow could be the same in both rolls by connecting the water supply in the manner indicated in FIG. 8. The components illustrated in FIG. 8 are the same as those shown in FIG. 7 but in this case the water supply line 52 is connected to the ports 33 of both rolls 1 and the discharge line 53 is connected to the ports 34 of both rolls.

The casting rolls may typically be of the order of 500 mm diameter and have an outer sleeve thickness of the order of 60 mm. The longitudinal flow passages may typically be of the order of 20 mm diameter. These may be formed by 45 equally spaced holes grouped into 15 zigzag or multi-pass channels.

We claim:

1. Apparatus for continuously casting metal strip comprising an assembly of a pair of casting rolls forming a nip between them and each provided with water flow passages extending adjacent the outer peripheral surfaces of the rolls longitudinally of the rolls, a metal delivery nozzle for delivery of molten metal into the nip between the casting rolls to form a casting pool of molten metal supported on the cast roll surfaces above the nip, a pair of pool confining walls engaging opposite end parts of the rolls to confine the pool at the ends of the nip, roll drive means to drive the casting rolls in counter-rotational directions to produce a solidified strip of metal delivered downwardly from the nip, and cooling water supply means for supply of cooling water to said longitudinal passages in the rolls, wherein each casting roll comprises central shaft means mounting the roll for rotation about a central axis, a circumferential wall disposed about the central axis and provided with said longitudinal water flow passages, end walls extending between the shaft means and the ends of the circumferential wall, and passages formed in at least one of the end walls for flow of water to and from said longitudinal water flow passages, wherein the longitudinal water flow passages are interconnected in groups such that each group of circumferentially spaced passages forms a single continuous water flow channel for flow of water back and forth between the two ends of the roll in passing from one end of the channel to the other and wherein outer end parts of the circumferential walls of the rolls are notched to define outwardly facing shoulders for engagement with said pool confining plates and said radial passages and interconnections between the longitudinal flow passages are disposed generally at the notched outer end parts of the circumferential walls of the rolls.

2. Apparatus as claimed in claim 1, wherein the radial passages and interconnections between the longitudinal flow passages are disposed generally in the vicinity of said shoulders.

3. Apparatus as claimed in claim 1, wherein the longitudinal passages are interconnected in groups of three defining three-pass water flow channels.

4. Apparatus as claimed in claim 3, wherein each roll has two sets of said radial passages disposed one at each end of the roll with one set communicating with first ends of the water flow channels and the other set communicating with the opposite ends of those channels.

5. Apparatus as claimed in claim 1, wherein the circumferential wall comprises an inner tubular roll body and a cylindrical sleeve providing the outer casting surface.

6. Apparatus as claimed in claim 5, wherein the inner tubular body is constructed of stainless steel to provide rigidity to the roll during casting.

7. Apparatus as claimed in claim 5, wherein the cylindrical sleeve is constructed of copper or copper alloy.

8. Apparatus as claimed in claim 1, wherein the rolls further comprise water supply and return ducts formed internally within the shaft means of the rolls and communicating with said radial passages.

9. Apparatus as claimed in claim 8, wherein the water supply means comprises a common source of cooling water for both rolls connected to the water supply ducts to supply cooling water to both rolls at essentially the same temperature.

10. Apparatus as claimed in claim 9, wherein the common source of cooling water comprises a cooling water pump connected to the water supply ducts of both rolls.

11. Apparatus as claimed in claim 10, wherein the water supply means further comprises a water cooling tower to receive water returned through the said return ducts for recirculation via said pump.

12. Apparatus as claimed in claim 9, wherein the water supply means is connected to the rolls such that water is supplied to the radial passages of one roll at one end of the roll assembly and to the radial passages of the other roll at the other end of the roll assembly.

13. Apparatus as claimed in claim 9, wherein the water supply means is connected to the rolls to supply water at essentially the same temperature to the radial passages of both rolls at the same end of the roll assembly.

* * * * *

UNITED STATES PATENT AND TRADEMARK OFFICE

CERTIFICATE OF CORRECTION

PATENT NO. : 5,996,680

DATED : December 7, 1999

INVENTOR(S) : FUKASE et al.

It is certified that error appears in the above-indentified patent and that said Letters Patent is hereby corrected as shown below:

Claim 1, line 20 (Column 6, line 38), before "passages", insert --radial--

Signed and Sealed this

Twenty-first Day of November, 2000

*Attest:*

Q. TODD DICKINSON

*Attesting Officer*

*Director of Patents and Trademarks*